US005241918A

United States Patent [19]

Hayes

[11] Patent Number: 5,241,918

[45] Date of Patent: Sep. 7, 1993

[54] APPARATUS FOR SEWING OVER-EDGE STITCH IN CARPET

[75] Inventor: Haskel D. Hayes, Rocky Face, Ga.

[73] Assignee: Eagle Parts & Machinery, Inc., Chatsworth, Ga.

[21] Appl. No.: 680,199

[22] Filed: Apr. 5, 1991

[51] Int. Cl.[5] ..... D05B 35/10; D05B 1/20; D05B 57/06

[52] U.S. Cl. ..... 112/7; 112/153; 112/162

[58] Field of Search ..... 112/7, 8, 137, 153, 112/136, 270, 197, 441, 269.1, 177, 172, 162

[56] References Cited

U.S. PATENT DOCUMENTS

| | | | |
|---|---|---|---|
| 3,100,469 | 8/1963 | Washburn | 112/269.1 X |
| 3,468,271 | 9/1967 | Johnson | 112/7 X |
| 3,943,864 | 3/1976 | Feighery | 112/7 |
| 4,062,307 | 12/1977 | Michelberger | 112/7 |
| 4,356,782 | 11/1982 | Ueyama et al. | 112/269.1 X |
| 4,791,874 | 12/1988 | Shiomi | 112/162 |

*Primary Examiner*—Clifford D. Crowder
*Assistant Examiner*—Paul C. Lewis
*Attorney, Agent, or Firm*—Kerkam, Stowell, Kondracki & Clarke

[57] ABSTRACT

An apparatus for sewing an over-edge stitch to form a butt-seam in sections of carpet or other thick workpieces is provided, wherein an existing over-edge stitching machine has four primary parts removed and replaced with four parts of different designs, the parts being the workpiece guide, the top looper, the top looper pivot arm and the bottom looper. The new workpiece guide forgoes using the attachments employed by the guide it replaces, and is instead soldered or otherwise secured to the existing needle plate, and the new workpiece guide has a finger extension which operates to keep thread loops formed by the stitching components in a loose configuration until substantially no further tension is produced on the thread loops by the stitching components.

8 Claims, 6 Drawing Sheets

APPARATUS FOR SEWING OVER-EDGE STITCH IN CARPET

BACKGROUND OF THE INVENTION

1. Field of the Invention

The present invention relates to an apparatus, namely a sewing machine, adapted to sew an over-edge butt-seam stitch in thick workpieces, for example, tufted carpet.

2. Description of Related Art

For economical reasons, many carpet manufacturers have installed in their mills equipment which performs certain manufacturing or finishing operations, such as dyeing, on a substantially continuous basis. Other such operations include latex application and pile shearing. The tufting of carpet, however, generally involves tufting yarn through a backing of a given width (12 feet, for example) and of a finite length, with the product coming from the tufting operation being wound onto rolls. Thus, in order to take full advantage of continuous dyeing equipment or other continuous processing equipment, the trail edge of one roll of tufted carpet must be secured to the leading edge of the following roll of carpet, and the securing process must be repeated for each successive roll used in the continuous process.

The securing of the edges of tufted carpet has presented numerous problems which have heretofore remained unsolved. Sewing or stitching the edges to one another has been regarded as the most economically viable approach to securing the edges. Specifically, it is believed that an over-edge stitch, to create what is termed a butt-seam, is the preferred means for joining the edges. A particular complication involved in producing an over-edge sewn seam joining edges of workpieces is that existing sewing machines are not capable of satisfactorily sewing materials having the thickness of a carpet pile, which may commonly be in the range of about ¼ inch to ¾ inch, and possibly even greater thicknesses. Existing machines instead are generally designed to produce seams in materials such as woven polypropylene, used in making flexible bulk container bags, which material is of a much lower thickness.

Examples of existing machines for sewing over-edge stitches are those sold by Union Special as Model No. 81500A and Model No. 81500B. The Model 81500A is described as being a one needle, two-thread over-edge machine for seaming heavy jute bags and sacks, and the Model 81500B is described as being essentially the same machine, with the added feature of a lifting upper feed for sewing heavy woven polypropylene stacking materials (container bags). The use of an over-edge stitch in seaming the carpet edges presents an additional problem in that the edges of the two rolls of carpet joined by the seam must lie substantially flat once stitched together, in order to prevent complications in the dyeing and other equipment. In sewing an over-edge seam with these existing machines, the edges of the materials to be sewn together are presented laying on top of one another. The stitches and seam produced by the Union Special machine are relatively tight, and do not permit the two workpieces and seam to be flattened out into an edge-abutting configuration, as it is not generally required that the seam be flattened in bag and sack fabrication.

Any attempt to flatten the edges at the seam made with existing machines would create additional stresses or stress concentration areas in the thread and at the carpet edges. Because a large amount of stress is experienced by the seams during the processing of the carpet, it is not advisable to attempt to "make do" with seams produced by the existing machine. Seam breaks or other failures at the seam area require shutting down the dyeing or other operation for a long period of time while the carpet is extracted from the equipment, thereby causing substantial losses in equipment down time.

One machine currently available on the market for producing an over-edge butt-seam at the edges of the carpet rolls has proven itself to be unreliable in that the moving parts tend to wear out or come out of adjustment frequently, leading to costly equipment down time. Further, the machine cannot sew both backed and unbacked goods satisfactorily.

A strong need continues to exist for a machine which will provide a reliable over-edge stitch in both backed and unbacked carpet which will allow the sewn edges to be flattened out into a substantially planar configuration for further processing of the joined carpet rolls in the mill.

It is therefore a principal object of the present invention to provide a machine which is capable of sewing an over-edge stitch at the edges of thick materials, such as tufted carpet, which will allow the materials at the seam to be flattened out after stitch is formed.

It is a further object of the present invention to provide a machine design for sewing an over-edge butt-seam at adjoining edges of two carpet rolls, wherein only a relatively small number of parts of an existing machine are replaced by parts specially designed to sew a wider, looser seam at the edges of the two carpet rolls.

It is a further object of the present invention to provide a workpiece or carpet guide having an extension arm adapted to retain several of the over-edge loops of previously formed stitches thereon, thereby substantially prohibiting a tightening of the previously formed stitches as the sewing operation progresses.

It is a further object of the present invention to provide a looper and guide assembly for producing a wider and looser stitch which is compatible with an existing over-edge sewing machine.

SUMMARY OF THE INVENTION

The above and other objects of the present invention are accomplished by modifying an existing Union Special sewing machine Model 81500A or 81500B to include a new workpiece guide attached to the needle plate of the machine, modified top and bottom loopers, and a modified top looper arm. These parts work in concert to yield a wider and looser stitch which is advantageously used as an over-edge butt-seamer for securing trailing and leading edges of carpet sections together so that the sections can be run in processes which operate on a substantially continuous basis.

It has been discovered in connection with the present invention that the width of the stitch made by an existing Union Special over-edge sewing machine could be increased from the five-eighths inch width it was originally designed to produce, to a width of between about one-and-one-eighth and one-and-one-half inches, without requiring substantial structural or component changes in the machine. As used herein, the "width" of a stitch is used to refer to the span from the edge of the workpieces being joined to the needle of the machine, which, when a stitch is formed, will define where the innermost extent of the stitch will exist.

The existing Union Special over-edge machine is provided with a workpiece guide which can be adjusted to a maximum of five-eighths of an inch spacing from the needle, thus defining the maximum stitch width attainable with the existing guide. Two tapped bores in the work surface of the machine are used with the existing workpiece guide, the guide having a slot through which two bolts or studs extend into the tapped bores, wherein the slot permits the spacing between the needle and the guide to be adjusted up to the five-eighths inch maximum.

The workpiece guide of the present invention avoids this limiting factor by foregoing the use of the tapped bores and instead secures the workpiece guide to the needle plate. The workpiece guide is provided with a standoff flange extending perpendicularly away from said needle, the flange in effect becoming an extension of the needle plate or work surface. Extending upwardly from the standoff flange is a vertical abutment surface along which the edges of the workpieces will slide as the edges feed through the machine. By appropriately sizing the standoff flange, the vertical abutment surface of the workpiece guide can be spaced by as much as one-and-one-half inches from the needle, or even more where other dimensional constraints of the machine or its components do not limit this distance.

While the workpiece guide of the present invention provides the ability to feed the edges of workpieces, e.g., carpet, through such that the needle will sew its stitch at an increased distance from the edges, the over-edge machine is still required to deliver an upper loop to the needle position such that the needle can stitch through this top loop. The existing top looper and top looper arm could not perform this function with the new workpiece guide, and a longer top looper arm was designed to allow the top looper to clear the workpiece guide at the side of the vertical abutment surface opposite the side along which the carpet edges slide. The use of a longer top looper arm also dictates that the lower looper have a greater reach such that it can be in a proper position to deliver thread to the top looper. The top looper of the present invention has also been modified to improve the performance of the machine.

One other important feature of the present invention is that the workpiece guide is provided with an extension finger which extends downstream of the needle and top looper in a direction substantially parallel to the advancing edges of the workpieces. The loops stitched by the needle and top looper will be looped over, or extend around, the finger, the finger thus preventing tightening of the loop against the edges of the workpieces as tension on the threads is exerted in stitching subsequent loops. The loops will slide along the finger as the workpieces are advanced through the machine, and each loop will finally slide off the end of the finger, at which point enough subsequent loops have been stitched so as to substantially eliminate any further tension from being exerted on the loops coming off the finger.

BRIEF DESCRIPTION OF THE DRAWINGS

These and other features of the present invention and the attendant advantages will be readily apparent to those having ordinary skill in the art, and the invention will be more easily understood from the following detailed description of the preferred embodiments of the present invention, taken in conjunction with the accompanying drawings wherein like reference characters represent like parts throughout the several views.

DETAILED DESCRIPTION OF THE PREFERRED EMBODIMENT

Figure 1:
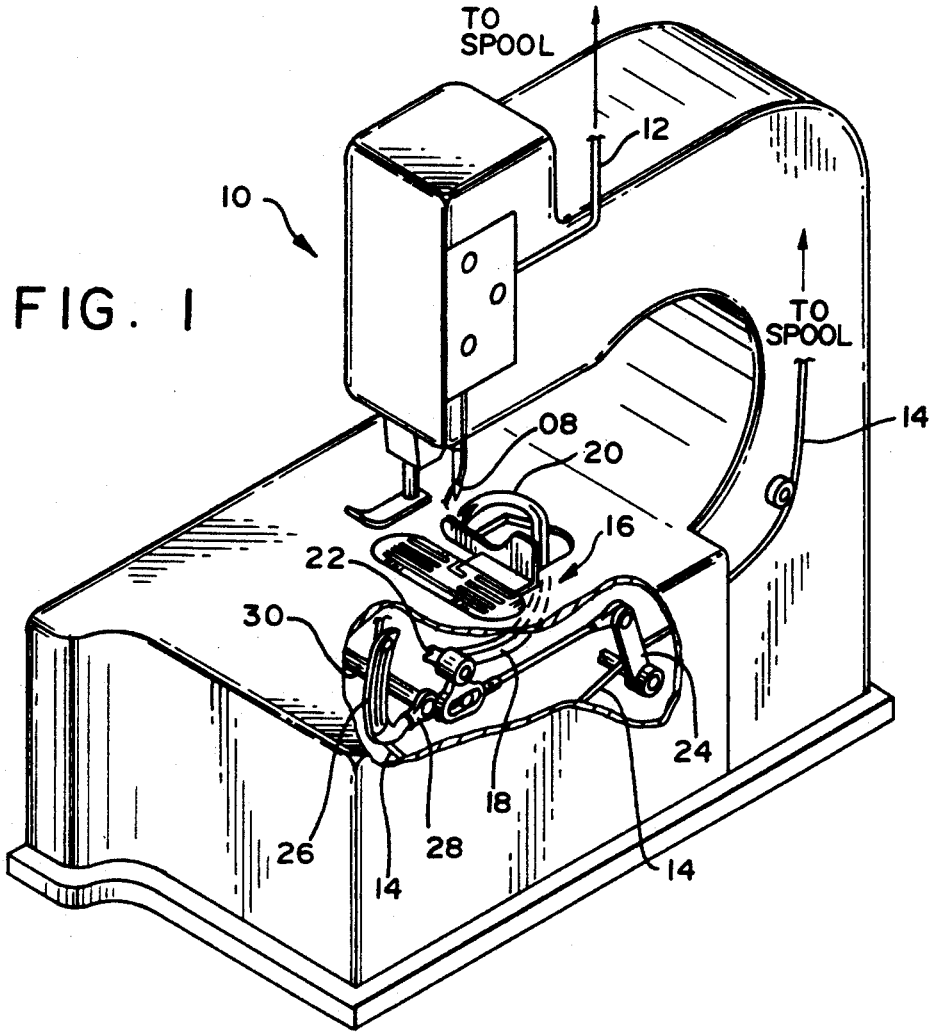
FIG. 1 is a substantially schematic perspective view of a sewing machine equipped with the components of the present invention.

Referring initially to FIG. 1, a sewing machine 10 of the type sold as the Union Special Model 81500A and 81500B for sewing an over-edge stitch is depicted in outline schematical form, and in partial cutaway view, to show the components added to the machine in accordance with the present invention. Much of the machine 10 employing the components of the present invention operates in the same general manner as it would in an unmodified state, which operation is well-known in the art of over-edge stitchers. More operational details will be described later in the specification, and it should suffice at this point to note that two threads 12, 14 are fed from two separate spools (not shown) to be used in forming the over-edge stitch.

The top looper assembly 16, comprising top looper pivot arm 18 and top looper 20 fixedly mounted in pivot arm 18, are disposed to pivot in a reciprocating manner about pivot pin 22. A rotating linkage assembly 24 is coupled to pivot arm 18, the linkage assembly 24 being unmodified from the existing machine. The linkage assembly 24 engages looper pivot arm 18 at a lower side of pivot pin 22 and the linkage assembly operates in a known manner to convert the rotational motion of a shaft (not shown) driving the linkage assembly 24 to the desired reciprocating motion for the top looper assembly 16.

The bottom looper 26 and bottom looper pivot arm 28 are driven by a separate and independent linkage, depicted schematically by shaft 30, which also produces a desired reciprocating or oscillating motion for operation of the bottom looper 26. The bottom looper provided with the existing machine is replaced with bottom looper 26, but the bottom looper pivot arm 28 remains unmodified when the machine 10 is configured in accordance with the present invention. As with the existing machine, the bottom looper 26 operates to advance thread 14 over to a point where top looper 20 can pick it up to bring the thread up over the aligned edges of the workpieces. A needle 08 oscillates in a known manner to bring thread 12 down through the workpieces at what will be termed a "stitch forming region".

Figure 6:
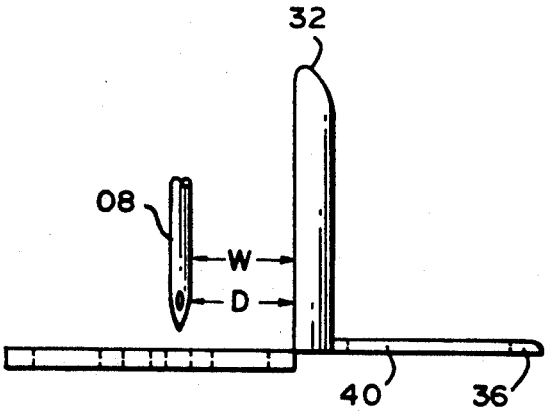
FIG. 6 (PRIOR ART)
FIG. 6 is an end elevation view of the needle plate and workpiece guide as known in the prior art.

One of the primary advances provided by the present invention involves replacing the existing workpiece guide 32 (FIGS. 2, 6) in the existing machine, with a workpiece guide 100 (FIGS. 3, 4, 5) of a completely different design. The known workpiece guide 32 is a casting (steel or aluminum) having a substantially vertical workpiece abutment surface 34 having a slotted flange 36 extending substantially perpendicularly from a back side 38 of the vertical surface in a direction away from the needle and stitch-forming region. The slot 40 of the flange is designed to be placed over two tapped bores 42 (FIGS. 9 A–D), disposed in the work surface 44 of the machine, whereby the guide can be bolted down by studs or bolts 46, in a known manner.

Figure 7A:
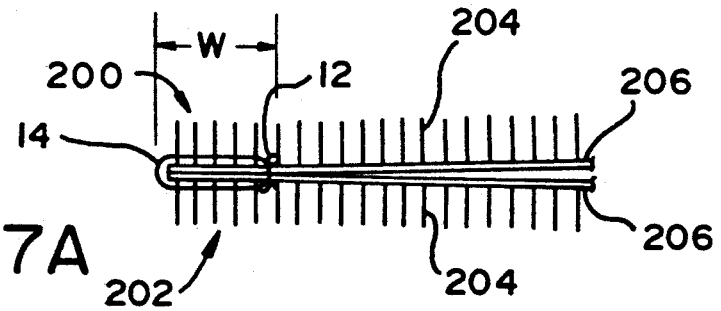
FIGS. 7 A–B are substantially schematic cross-section views of an over-edge stitch sewn through two edges of tufted carpet with a machine employing the workpiece guide of FIGS. 2 and 6.

The existing bores 42 and cooperating slot 40 permit some adjustment of the distance D between the vertical abutment surface 36 and the needle 08 (see FIG. 6), but this design for mounting the workpiece guide 32 inherently limits the range of permissible adjustment. Another limiting factor in adjustment range, as will be readily apparent to those skilled in the art, is that further adjustment of the workpiece guide 32 can lead to interference with moving parts, primarily the top looper. These factors combine to limit the width W (FIGS. 6,7A) of the stitch being formed, defined as the distance from the edge of the carpet or other workpieces to the needle, looking "end on" as in FIG. 6, to five-eighths of an inch on the existing machine. It has been determined in accordance with the present invention that, in order to obtain a reliable seam in sewing an over-edge butt seam into thicker materials such as the edges of the ends of carpet rolls, a larger width W′ (FIGS. 3, 8A), on the order of about 1⅛ inches to about 1½ inches is desired.

Figure 7B:
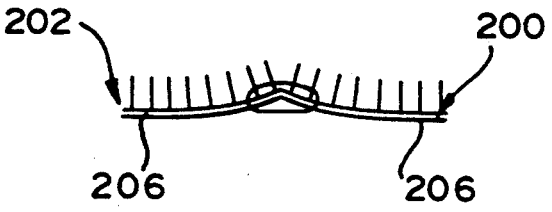

The prior art workpiece guide 32 has a further drawback when it comes to the task of sewing an over-edge seam at the edges of two pieces of carpet, wherein the seam must be loose enough to later permit the two edges of the carpet sections to be substantially completely flattened out. The problem presented is best explained by illustration. FIGS. 7 A,B are schematic cross-sectional representations of the stitch which would be sewn through two back-to-back edges of two sections 200, 202 of tufted carpet using the machine 10 equipped with the prior art workpiece guide 32. Because the prior art guide 32 permits each loop formed in the stitch to slide off of the end of the guide as the next stitch is being sewn, or at best holds only one formed loop thereon while the next stitch is sewn, tension continues to be exerted on the previously formed stitches after sliding off the workpiece guide 32, causing the stitches to tighten against the carpet pile 204, and in the extreme situation, causing the stitches to tighten tautly against the carpet backing 206. This problem is further aggravated because the prior art looper assembly makes a smaller loop and tighter stitch to begin with, as it was not designed to sew thicker materials of any type. As a result, when an attempt is made to flatten the two sections of carpet 200, 202, there is not enough thread length in each stitch (i.e. the stitch is not sufficiently loose) to permit the stitched area to flatten out into a true butt-seam configuration, and as a result the pieces will come out as shown in FIG. 7B. Even in situations in which a particular piece of machinery could accept materials having the bulge at the seam, the stress on the thread and on the carpet back is very large, and thus susceptible to a break in the thread or in a "tear-through" of the thread through the carpet backing. As noted previously, the equipment down time costs are so high that frequent and even occasional seam failures cannot be tolerated.

Figure 3:
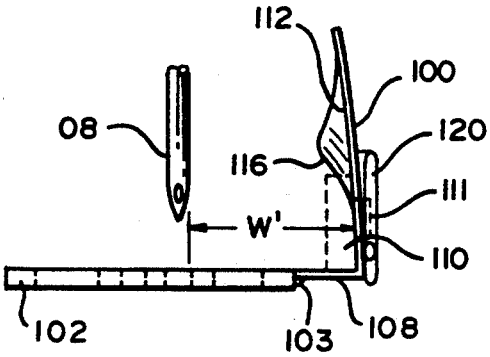
FIG. 3 is an end elevation view of a needle plate and the workpiece guide of the present invention.
Figure 4:
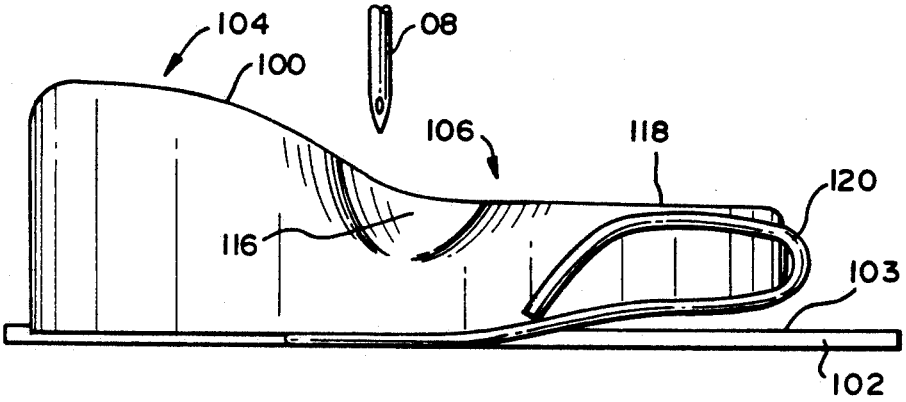
FIG. 4 is a rear elevation view of a needle plate and the workpiece guide of the present invention.
Figure 5:
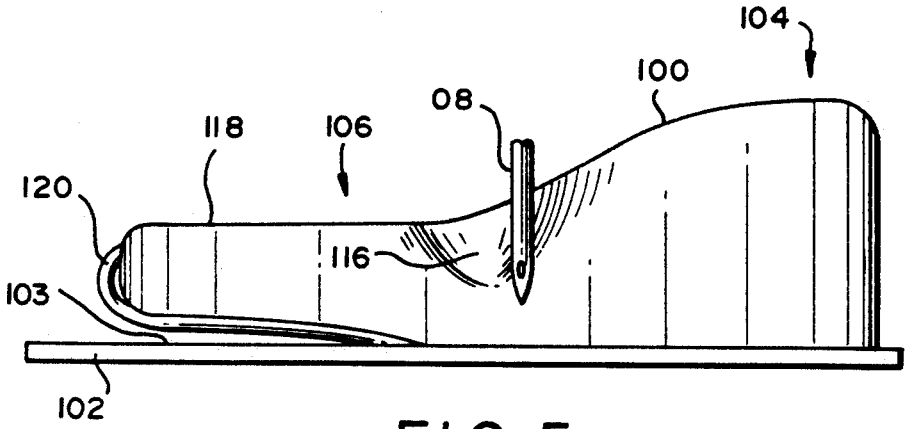
FIG. 5 is a front elevation view of a needle plate and the workpiece guide of the present invention.
Figure 12:
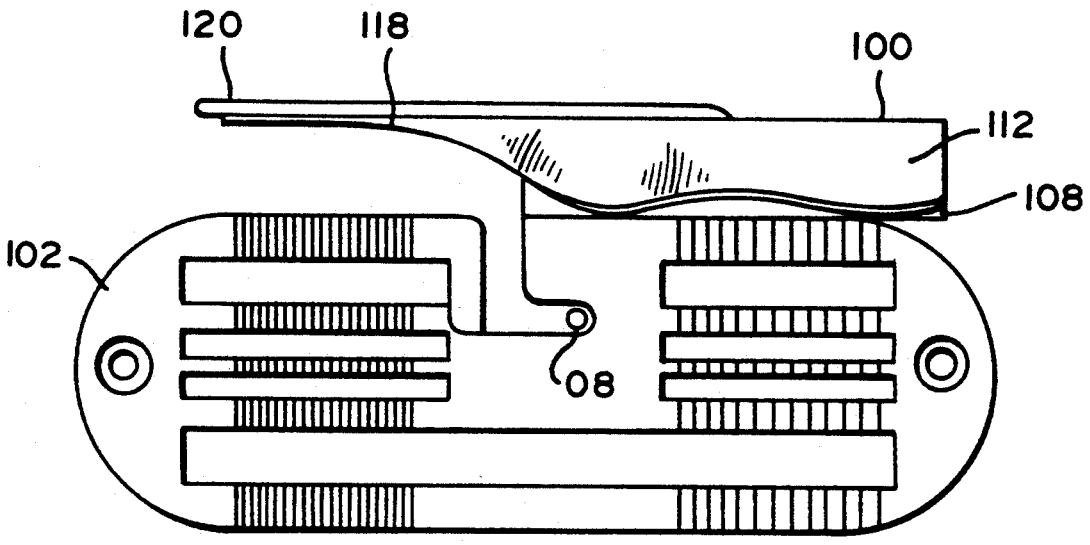
FIG. 12 is a top plan view of the needle plate of the machine to which the workpiece guide of the present invention is attached.

The workpiece guide 100 of the present invention, as shown in FIGS. 3, 4, 5, as well as in FIG. 12 overcomes both of the above-noted drawbacks of the prior art workpiece guide 32 when performing over-edge stitching in thicker materials, such as tufted carpet. The workpiece guide 100 of the present invention is preferably soldered represented by bead 103 to the existing needle plate 102, through which the needle passes in sewing through the work to form a loop at the lower side of the work. By relying on a fastening means, preferably solder, to secure the guide 100 along part of the length of the needle plate 102, as compared with being secured only at one side of aperture 119 in work surface 44, the workpiece guide can better withstand forces along its entire length, and permits the use of an extension piece, the advantages of which will be discussed later. For ease of reference herein, the location of certain components of the workpiece guide 100 and of certain other components will be referred to in terms of being disposed on the pre-stitch side 104 (FIGS. 4,5) or the post-stitch side 106 (FIGS. 4,5) of the needle 08.

In general, workpiece guide 100 has a longitudinal extent which extends along both the pre-stitch and post-stitch side of needle 08 for about two inches. Looking back to FIG. 3, workpiece guide 100 has a standoff flange 108 extending outwardly away from needle 08, the flange 108 essentially forming an extension of the work surface 44 of the machine or needle plate, and increasing the potential stitch width to W′. While the prior art workpiece guide yielded a maximum ⅝ inch stitch width, the use of an appropriately dimensioned standoff flange according to the preferred embodiment of the present invention will increase the potential stitch width up to 1½ inches. It is believed at this point in time that the desired stitch width for sewing the edges of carpet will be in the range of about 1⅛ inches to about 1½ inches. Therefore, the preferred embodiment of the present invention will employ a standoff flange 108 which is of a dimension positioning needle 08 about 1½ inches inboard of the edges of the carpet. To achieve a range of adjustability using this workpiece guide 100, one or more spacer wedges 110, shown in broken lines in FIG. 3 may be fit against the substantially vertically disposed abutment surface 112 and held in place by clip III. The use of wedges 110 will have the effect of reducing the effective distance between the vertical abutment surface of the workpiece guide 100 and the needle 08.

The workpiece guide 100 has a slight curvature near its pre-stitch end 104 in order to keep the edges of the carpet from riding up over the guide. In a central section 116 at the pre-stitch side 104 of needle 08, and substantially immediately adjacent to the needle, the abutment surface of the guide has an increased curvature in order to allow a thread loop to be brought over the guide 100 to the stitch forming region underneath needle 08.

An important feature of the workpiece guide 100 of the present invention is the finger 118 which preferably extends on the order of one or more inches past the needle on the post-stitch side 106 of the needle. As compared with the prior art guide 32, which holds at most about one loop from a previous stitch while a subsequent stitch is made in the workpieces, the finger 118 extension holds at least three and more preferably about six loops from previously sewn stitches. Finger 118 preferably extends from a point over the cutout 119 in work surface 44 of the machine 10, to a point over work surface 44, as best shown in FIGS. 7 A–D. As such, a lower edge of finger 118 preferably slants or tapers upwardly toward the end of the finger 118 such that the lower edge will be at a level above an upper surface 103 of needle plate 102. The finger 118 preferably has a vertical height on the order of about one-half to one inch, thereby approximating a nominal height of two carpet edges held back-to-back and run through the machine 10.

Figure 8A:
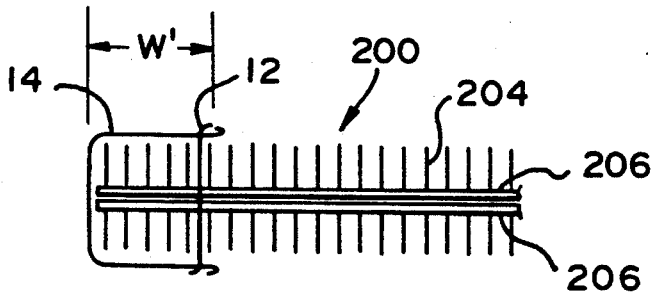
FIGS. 8 A–B are substantially schematic cross-section views of an over-edge stitch sewn through two edges of tufted carpet with a machine employing the workpiece guide of the present invention depicted in FIGS. 3–5.
Figure 8B:
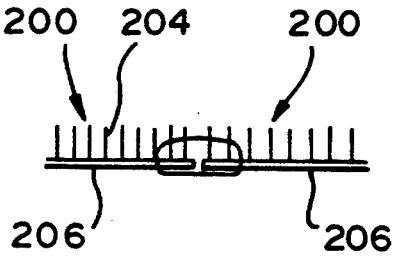

Finger 118 has a loop 120 of steel or aluminum wire secured to the side of the finger 118 opposite that on which the workpieces will pass. This wire loop 120, which is preferably a round wire of about ⅛ inch diameter, provides a degree of structural reinforcement to finger 118, but more importantly, the loop provides additional surface area around which the thread loops 300 (FIGS. 9 A–D) retained thereon must pass. The thread loops 300 (FIGS. 9 A–D) are thus prevented from tightening against and into the pile of the carpet 200, as illustrated in FIG 8A. By the time a thread loop slides off the end of finger 118, at least about three, and preferably about six to eight, additional or subsequent stitches have been made in the seam, and there will effectively be no tension exerted by the action of the needle and loopers on the threads of the stitch as the thread loop slips off finger 118. The stitches thus formed will maintain a sufficient looseness such that the two edges of the carpet can be flattened out at the seam into a true edge-to-edge abutting engagement or butt-seam, as illustrated in FIG. 8B, without exerting unacceptably high stresses on the threads of the stitches.

By way of analogy, the prior art workpiece guide operates in a manner similar to a lace-up shoe having, for example, three sets of eyelets. The entire lacing arrangement can be tightened by pulling on the loose ends of the laces. In contrast, the workpiece guide of the present invention with the extension finger operates in a manner similar to a lace-up shoe having approximately 6–8 sets of eyelets, as, for example, in a high-top sneaker. Pulling on the loose ends of the laces of a laced high-top sneaker will effectively tighten only one or two of the crossover "stitches" of the lace nearest the loose ends, while no tension is generated at those crossover "stitches" closer to the toe of the shoe, which "stitches" are therefore not tightened by pulling on the loose ends of the laces.

Figure 11:
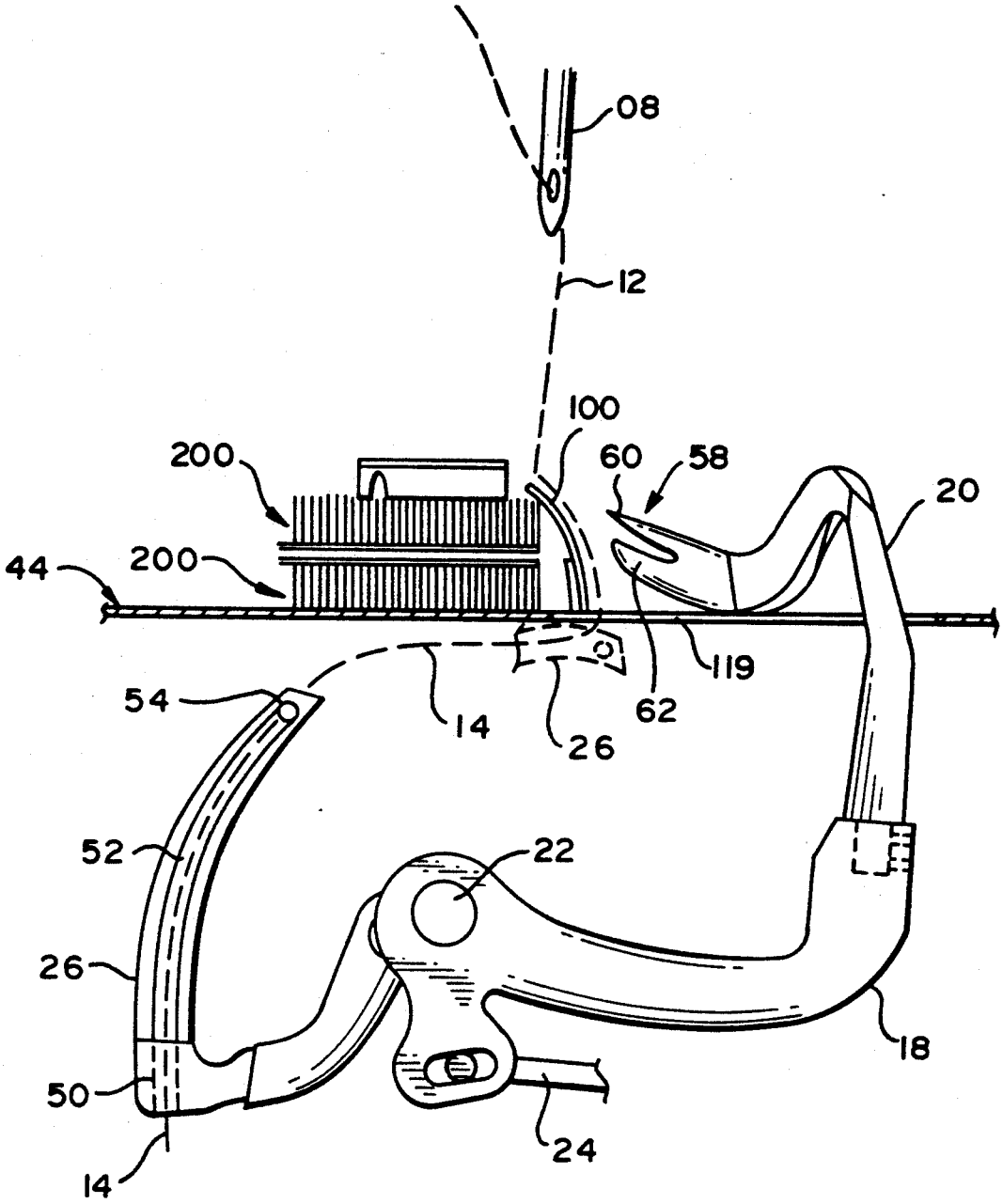
FIG. 11 is aside elevation view of the stitch-forming components of the preferred embodiment of the present invention.

Turning now to FIGS. 9 A–D and FIG. 11, the over-edge stitching operation will briefly be described. As can be seen from FIG. 1 and FIG. 11, thread 14 comes from a spool through a bore 50 at the back end of bottom looper 26, and the thread rides in a channel 52 extending along the length of bottom looper, and the thread 14 crosses through to the other side of bottom looper 26 at aperture 54. In a known manner, bottom looper 26 is designed to advance to a forward position where the top looper 20 will be able to pick up thread 14 at the back side of bottom looper 26, as best seen in FIG. 9A. The advancement of bottom looper 26 to the forward position is also timed such that the bottom looper 26 will engage thread 12 as needle 08 begins to retract upwardly after it finishes downward stroke. A loop formed by thread 12 will thus be formed at the lower side of the workpieces with thread 14 passing therethrough by virtue of thread 14 extending from the back end to the front end of bottom looper 26.

Figure 10:
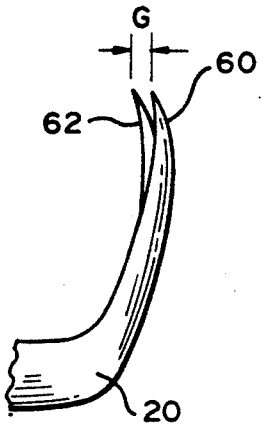
FIG. 10 is a top plan view of the top looper of the present invention.
Figure 9A:
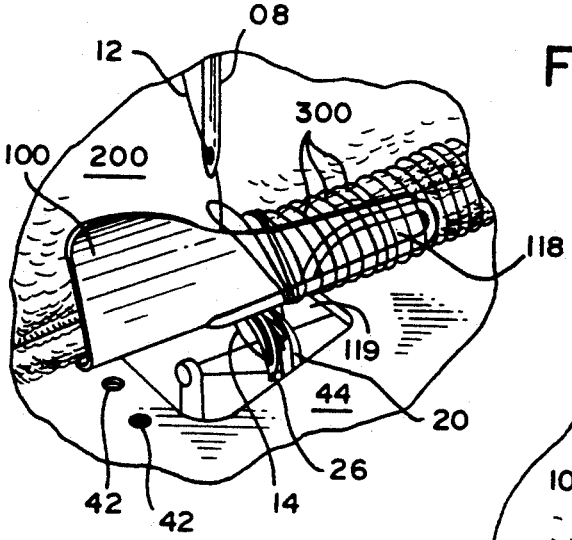
FIGS. 9 A–D are perspective views of a sequence of steps in the stitching process using the components of the present invention.
Figure 9B:
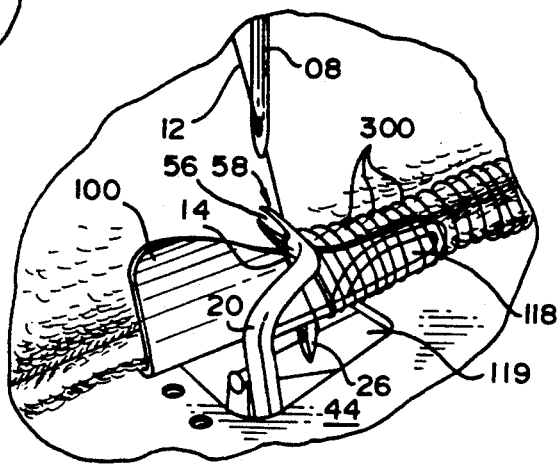
Figure 9C:
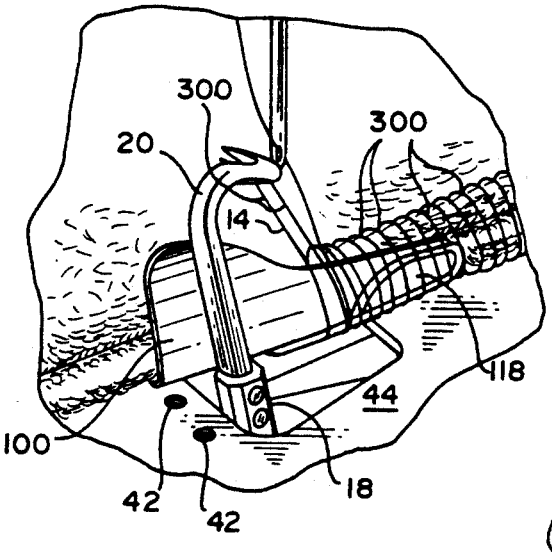

FIG. 9A depicts the top looper 20 as it begins to advance upwardly toward its forward position over workpiece guide 100. FIG. 9B shows that thread 14 is picked up off of bottom looper 26 in a slot 56 in a fork 58 disposed on the end of top looper 20, the fork 58 having an upper tine 60 and a lower tine 62 (FIG. 10). FIG. 9C shows top looper 20 at its fully advanced forward position. The top of top looper pivot arm 18 can be seen at the base of workpiece guide in this Figure, and it can further be noted that bottom looper 26 has retracted from its fully forward position, as it is not seen in this Figure, and needle 08 is at the top of its stroke. Top looper 20 has formed a loop 300 with thread 14, and has advanced the loop over to a stitch forming region under needle 08.

Figure 9D:
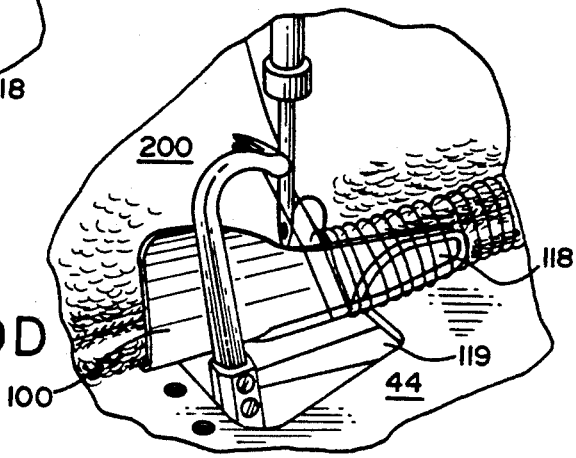

FIG. 9D shows top looper 20 in the same position as FIG. 9C, evidencing that the linkage assembly 24 provides a "dwell time" leaving the top looper at its forward position while needle 08 travels downwardly through the loop created by top looper 20, as seen in FIG. 9D. Once needle 08 has traveled downwardly through the loop and into the upper surface of the top workpiece, the top looper 20 and its associated looper arm 18 and linkage assembly 24 are designed to cycle top looper 20 back to the position depicted in FIG. 9A to pickup thread 14 to create a subsequent loop.

Figure 2:
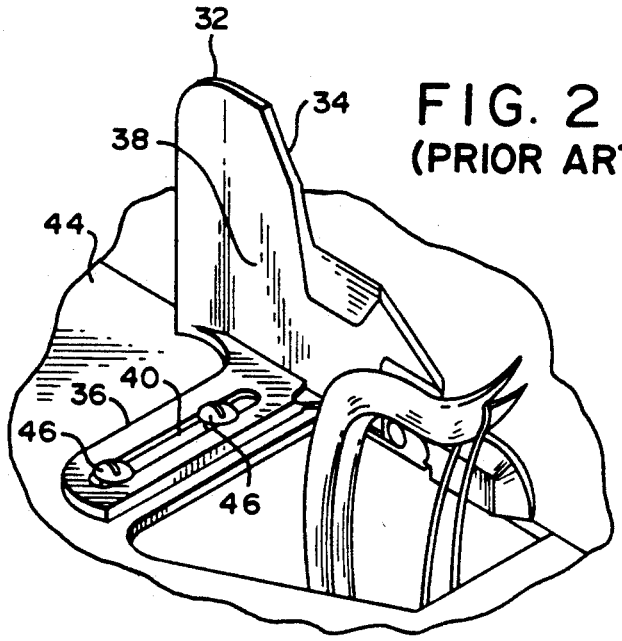
FIG. 2 (PRIOR ART)
FIG. 2 is a perspective view of the prior art workpiece guide showing the position of the top looper in its extended position.

It can be seen in all of FIGS. 9 A–D that finger 118 of looper guide retains a plurality of loops 300, preferably between about 3–8, extending therearound as the stitching operation proceeds, whereas the prior art guide 32 would have shed the loop just short of the end of the cutout section 119 in the work surface 44 of the machine 10 (see FIG. 2).

Looking again to FIG. 11, it will be recognized that the workpiece guide 100 of the present invention is disposed in an area over the cutout section 119 of the work surface 44 of the machine, which is squarely in the path of the top looper assembly of the existing prior art machine. In order to provide clearance for the top looper around the workpiece guide 100, top looper arm 18 was extended by about three-eights of an inch to move top looper 20 further back with respect to the guide 100 and cutout section 119. Because this modification also affected the position of the fork 58 at the lower thread pick-up position, the length of bottom looper also was required to be extended by about three-eights of an inch in order to deliver thread 14 to the fork 58.

One further aspect contributing to the improved operation of the top looper of the present invention can be seen in FIG. 10. The fork portion at the end of the top looper employed in the prior art had a lower tine which was disposed substantially directly under the upper tine, such that the lower tine would not be visible or would barely be visible when viewed from the top of the fork. In contrast, the top looper 20 of the present invention, as seen in the top view of FIG. 10, is provided with a lower tine 62 which curves inwardly of the upper tine 60 to an extent such that a gap G can be seen between the tines when viewed from the top of the fork. This design change improves the ability of the top looper 20 to pick up thread 14 from the bottom looper 26. The bottom looper, both in the prior art and in the design of the present invention, is provided with a recess at the side of the bottom looper where the thread is picked up by the top looper. The provision of the increased curvature in the lower tine 62 improves the reliability with which the top looper 20 picks up the thread 14 from bottom looper 26.

The foregoing description of the preferred embodiment of the present invention is provided to illustrate the advantages provided by the present invention. Various modifications or alterations may become apparent to those or ordinary skill in the art upon reading the foregoing description without deviating from the spirit and scope of the present invention. The scope of the invention is therefore to be determined by reference to the appended claims.

What is claimed is:

1. In a machine for sewing stitches to produce an over-edge seam at the aligned edges of two workpieces to be joined, the improvement comprising:

a workpiece guide extending substantially parallel to a workpiece feed direction, said workpiece guide further comprising means for preventing loop portions of said stitches formed over the edges of the workpieces from tightening around said edges of said workpieces; said machine further comprising a top looper coupled to the machine, said top looper having means for delivering a loop over said aligned edges of said workpieces, said loop delivering means including a fork disposed at a distal end thereof, said fork having an upper tine and a lower tine, wherein said lower tine curves in the same direction as said upper tine, and wherein said lower tine has a greater degree of curvature than said upper tine.

2. A workpiece guide for use on a machine for sewing an over-edge stitch at aligned edges of two workpieces to be joined, said workpiece guide having a substantially vertically extending abutment surface being so constructed and arranged to be aligned substantially parallel to a workpiece feed direction when said workpiece guide is installed on said sewing machine, said workpiece guide further having finger means extending at one end thereof for retaining therearound a plurality of thread loops formed into stitches by said machine, said finger means being so constructed and arranged to extend, when said workpiece guide is installed on said sewing machine, a sufficient distance from a stitch forming region where a needle of said machine is disposed to retain at least three loops formed by said machine therearound, said finger means also including spacer means secured to a side of the finger means opposite a side of said finger means along which the workpieces will pass, for providing additional surface over which said loops are formed, thereby increasing a length of thread used in forming each stitch.

3. A workpiece guide as recited in claim 2 wherein said guide is secured to an edge of a needle plate of said machine immediately adjacent a cutout in a work surface of said machine by a standoff flange extending substantially perpendicularly to said vertical abutment surface at a lower edge of said workpiece guide.

4. A workpiece guide as recited in claim 3, further comprising means for adjusting a distance between a needle of said sewing machine and said vertical abutment surface, said distance adjusting means comprising at least one spacer wedge and means for securing said spacer wedge to said vertical abutment surface on a side of said vertical abutment surface along which said workpieces will pass when said workpiece guide is installed on said sewing machine.

5. A workpiece guide as recited in claim 2, wherein a portion of said vertical adjustment surface is curved inwardly toward said needle at said stitch forming region to provide additional clearance for the travel of said top looper to said stitch forming region.

6. In a machine for sewing stitches to produce an overedge stitch seam at the aligned edges of two workpieces to be joined, the improvement comprising:

a workpiece guide having a substantially vertical abutment surface extending substantially parallel to a workpiece feed direction, said workpiece guide further comprising means for preventing loop portions of said stitches formed over the edges of the workpieces from tightening around said edges of said workpiece, said loop tightening preventing means comprising finger means extending at one end of said workpiece guide for retaining therearound a plurality of thread loops formed into stitches, said finger means being so constructed and arranged to extend a sufficient distance from a stitch forming region where a needle of said machine is disposed to retain at least three loops formed by said machine therearound, said finger means also including spacer means secured to a side of the finger means opposite a side of said finger means along which the workpieces will pass, for providing additional surface over which said loops are formed, thereby increasing a length of thread used in forming each stitch.

7. A machine as recited in claim 6, wherein said workpiece guide further comprises means for increasing a distance between said needle and said vertical abutment surface, said distance increasing means comprising a standoff flange extending perpendicularly from said vertical abutment surface in a direction toward said needle.

8. A machine as recited in claim 7 wherein said workpiece guide further comprises means for adjusting said distance between said needle and said vertical adjustment surface, said distance adjusting means comprising at least one spacer wedge and means for securing said at least one spacer wedge to a surface of said vertical abutment surface facing said needle.

* * * * *

UNITED STATES PATENT AND TRADEMARK OFFICE

CERTIFICATE OF CORRECTION

PATENT NO. : 5,241,918

DATED : September 7, 1993

INVENTOR(S) : Haskel D. HAYES

It is certified that error appears in the above-identified patent and that said Letters Patent is hereby corrected as shown below:

Column 9, line 22 (Claim 1, line 2) after "over-edge" insert --stitch--.

Signed and Sealed this

Twenty-fourth Day of May, 1994

*Attest:*

*Attesting Officer*

BRUCE LEHMAN

*Commissioner of Patents and Trademarks*